US006615720B2

(12) United States Patent
Oh

(10) Patent No.: US 6,615,720 B2
(45) **Date of Patent: *Sep. 9, 2003**

(54) BRAYER BALL

(75) Inventor: Wan-Young Oh, Seoul (KR)

(73) Assignee: DN Craft Corporation, Songpa-gu (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/954,295

(22) Filed: Sep. 18, 2001

(65) Prior Publication Data

US 2002/0144615 A1 Oct. 10, 2002

(30) Foreign Application Priority Data

Apr. 10, 2001 (KR) ..... 2001-9942

(51) Int. Cl.[7] ..... B41F 9/00
(52) U.S. Cl. ..... 101/328; 101/329; 101/405
(58) Field of Search ..... 101/329, 328, 101/333, 405, 330, 331, 406; 401/208, 218

(56) References Cited

U.S. PATENT DOCUMENTS 3,861,511 A * 1/1975 Nelson et al. ..... 400/161.1
3,924,722 A * 12/1975 Wienhold ..... 400/62
4,176,977 A * 12/1979 Shepard, Jr. ..... 400/320
5,297,981 A * 3/1994 Maxim et al. ..... 446/437
5,495,800 A * 3/1996 Weissbein et al. ..... 101/329
5,934,968 A * 8/1999 Lin ..... 446/358
6,378,426 B1 * 4/2002 Furr et al. ..... 101/329
6,432,071 B1 * 8/2002 Hsieh ..... 601/72
6,520,081 B2 * 2/2003 Oh ..... 101/329

* cited by examiner

*Primary Examiner*—Leslie J. Evanisko
*Assistant Examiner*—Kevin D. Williams
(74) *Attorney, Agent, or Firm*—Browdy and Neimark P.L.L.C.

(57) ABSTRACT

A brayer ball, used in a brayer that is a hand-operated ink-stamping device of small size used for making proofs, is disclosed. This brayer ball consists of a spherical solid or hollow core body, and a ball cover formed on the spherical core body and having an external pattern consisting of a variety of letters, figures and/or characters. The brayer ball smoothly rolls on a target sheet in any desired direction without being limited in its rolling direction during a stamping process. This brayer ball thus prevents a stamped pattern from being distorted, deformed, or undesirably, partially faint or broken.

15 Claims, 7 Drawing Sheets

BRAYER BALL

BACKGROUND OF THE INVENTION

1. Field of the Invention

The present invention relates to brayers, or hand-operated ink-stamping devices of small size typically used for making proofs and, more particularly, to a brayer ball preferably used in such brayers and fabricated with a patterned ball cover formed on a spherical core body and having an external pattern consisting of a variety of letters, figures and/or characters, the brayer ball thus smoothly rolling on a sheet in any desired direction without being limited in its rolling direction during a stamping process.

2. Description of the Prior Art

FIGS. 1*a* and 1*b* are views of a conventional brayer. As shown in the drawings, the conventional brayer 100 comprises a handle 110 and a cylindrical brayer roller 400. The handle 110 has a roller holder head 200 provided with two brackets 220. The two brackets 220 integrally extend downward from opposite sides of the roller holder head 200, with a yoke bearing 210 formed at the lower end of each bracket 220 to hold each end of a roller shaft 300. The brayer roller 400 is a cylindrical member having a predetermined length, and is fitted over the roller shaft 300 so as to be rotatable around the roller shaft 300. The brayer roller 400 is made of rubber, and is embossed on its circumferential surface to form a desired pattern, consisting of a variety of letters, figures and/or characters.

In order to stamp a desired pattern onto a sheet using the brayer 100, a user rolls the brayer roller 400 on an inkpad to allow the patterned surface of the roller 400 to be smeared with ink. Thereafter, the brayer roller 400 is rolled on a target sheet, such as a paper sheet, to stamp the pattern of the roller consisting of letters, figures and/or characters onto the sheet.

During a stamping process using such a conventional brayer 100, the desired pattern of the brayer roller 400 is effectively stamped onto a sheet only when the user rolls the brayer roller 400 on the sheet by pulling or pushing the brayer 100 linearly by the hand, gripping the handle 110, to form a linear print. When the brayer roller 400 is rolled on a sheet to form a circular print as shown in FIG. 1*b*, the inside portion of the longitudinal cylindrical roller 400 around the center of the circular print is rolled at a low speed with a small radius "H1".

On the contrary, the outside portion of the longitudinal cylindrical roller 400 around the outer edge of the circular print is rolled at a high speed with a large radius "H2". Due to such a difference in the radius and rolling speed between the two portions of the brayer ball. 400 while rolling the brayer 100 through a circular or curved trace, the letters, figures and/or characters of the pattern stamped onto the sheet are undesirably distorted and deformed. In addition, the stamped effect in such a case is not uniform since the stamped pattern is undesirably, partially faint or broken at a portion stamped by the outside portion of the roller 400. Furthermore, the inside portion of the stamped pattern is smeared with a sufficient amount of ink, and so it is clearly and thickly stamped, but is not easily or quickly dried, thus being likely to undesirably run over the sheet.

SUMMARY OF THE INVENTION

Accordingly, the present invention has been made keeping in mind the above problems occurring in the prior art, and an object of the present invention is to provide a brayer ball, which is fabricated with a patterned ball cover, having an external pattern consisting of letters, figures and/or characters and formed on a spherical core body, and which smoothly rolls on a sheet in any desired direction without being limited in its rolling direction during a stamping process, and which thus prevents a stamped pattern from being distorted, deformed, or undesirably, partially faint or broken.

In order to accomplish the above object, the present invention provides a brayer ball, comprising a spherical solid or hollow core body, and a ball cover formed on the spherical core body and having an external pattern consisting of a variety of letters, figures and/or characters.

BRIEF DESCRIPTION OF THE DRAWINGS

The above and other objects, features and other advantages of the present invention will be more clearly understood from the following detailed description taken in conjunction with the accompanying drawings, in which:

FIGS. 1*a* and 1*b* are views of a conventional brayer, in which:

FIG. 1*a* is a front view of the brayer; and

FIG. 1*b* is a left side view of the brayer;

DETAILED DESCRIPTION OF THE INVENTION

Figure 1A:
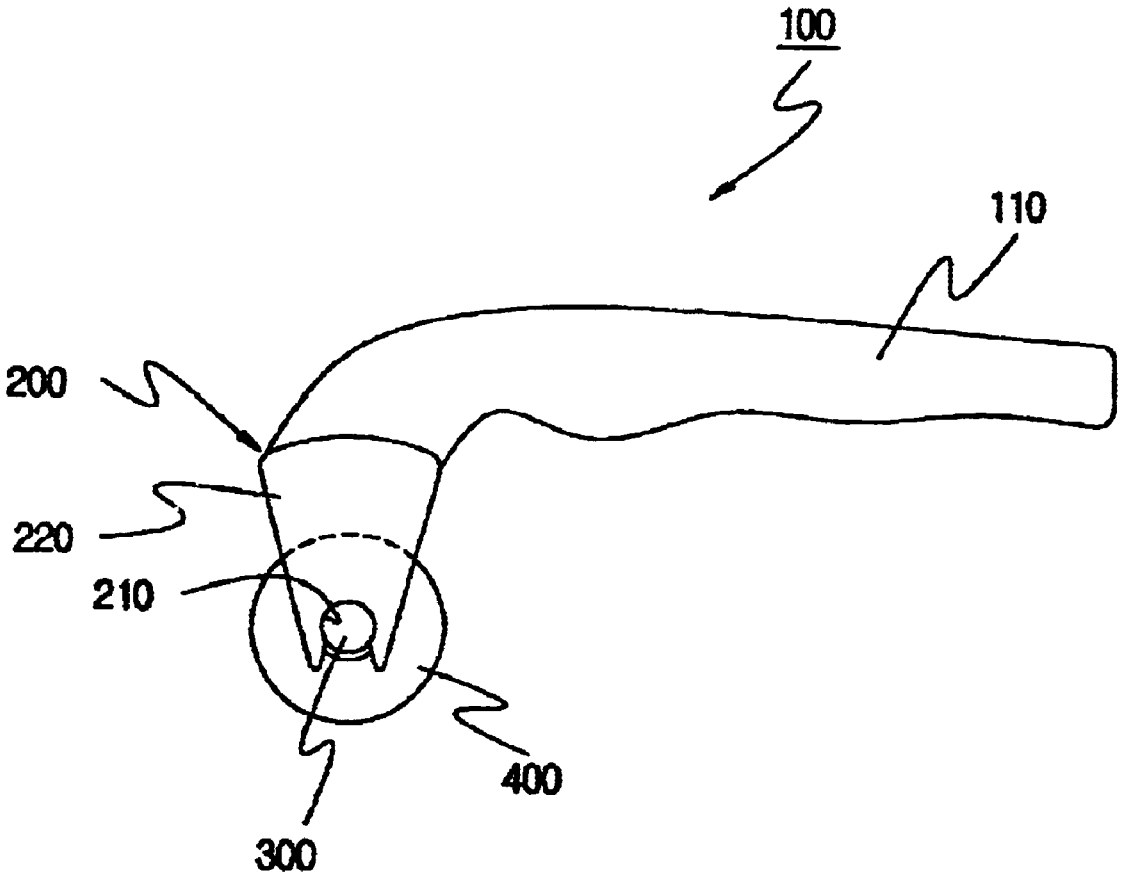
FIG. 1a (PRIOR ART)
Figure 1B:
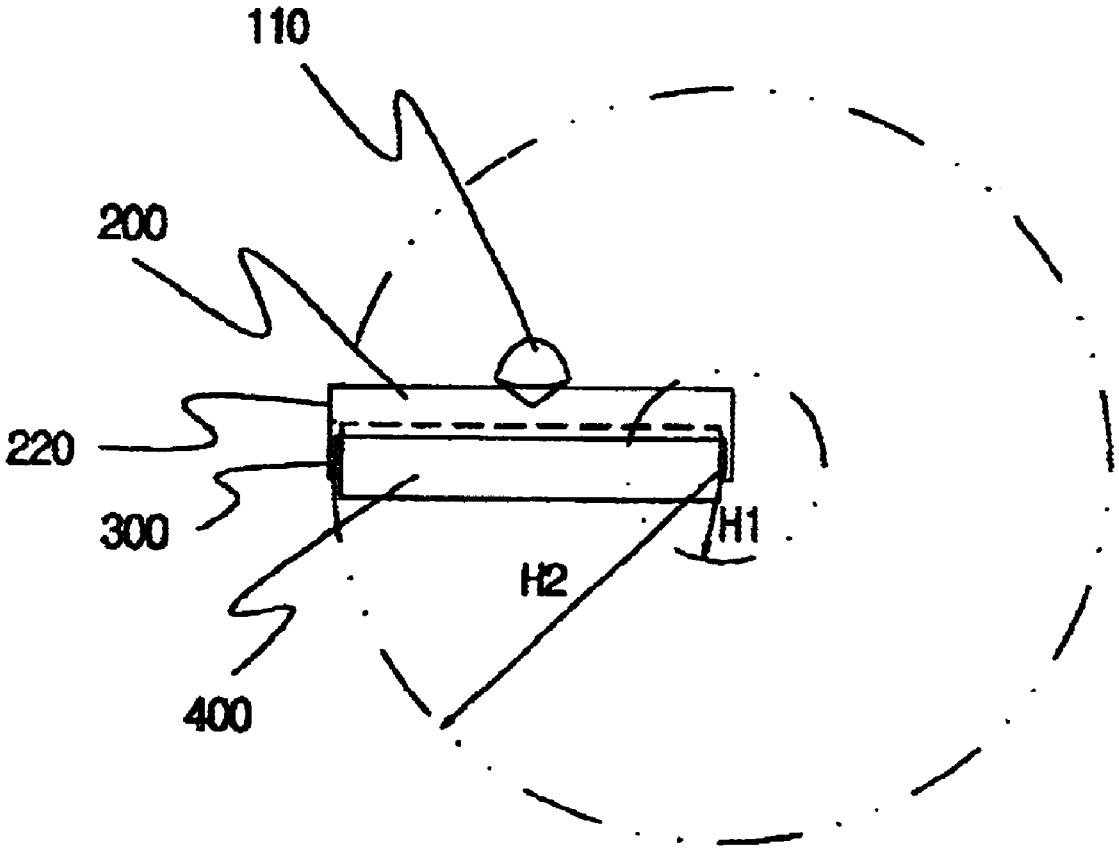
FIG. 1b (PRIOR ART)

Reference now should be made to the drawings, in which the same reference numerals are used throughout the different drawings to designate the same or similar components.

Figure 2:
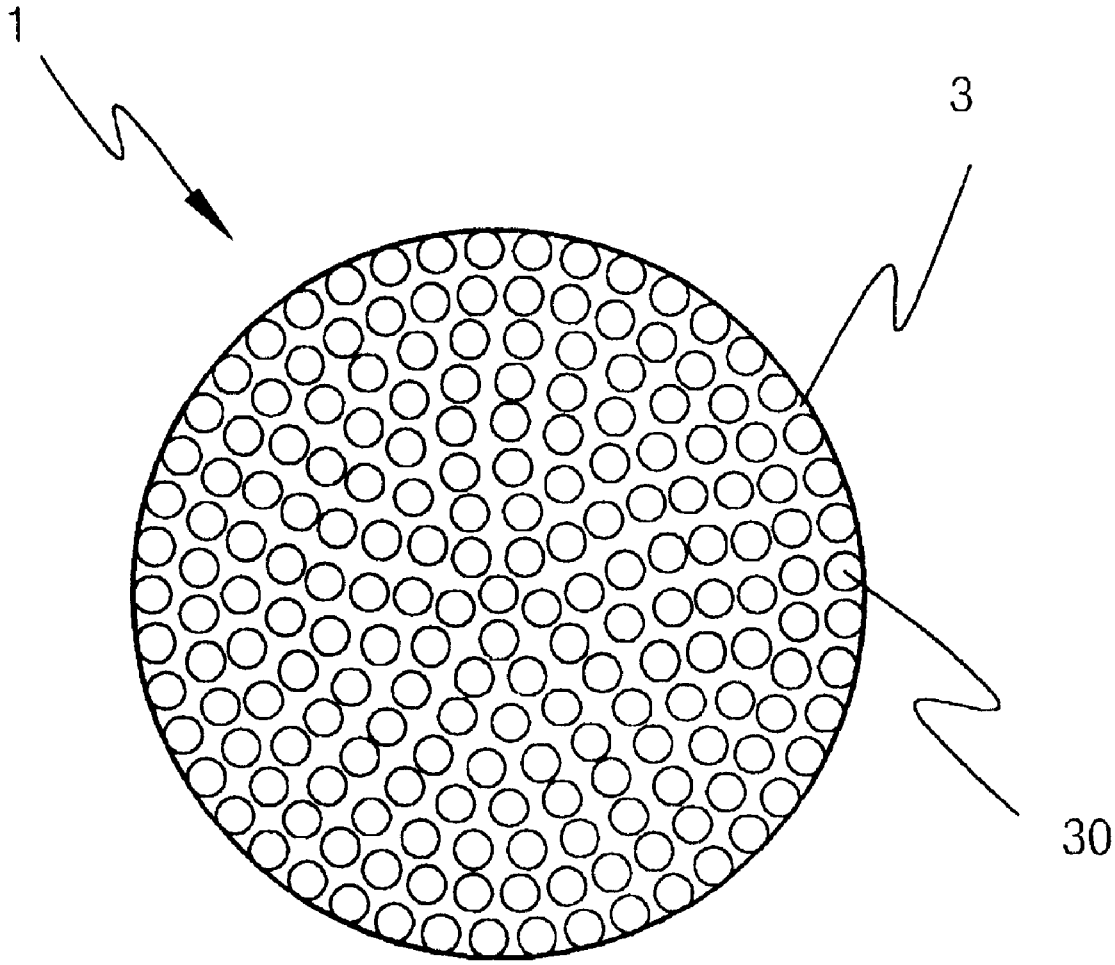
FIG. 2 is a front view, showing the appearance of a brayer ball in accordance with the primary embodiment of the present invention.
Figure 3:
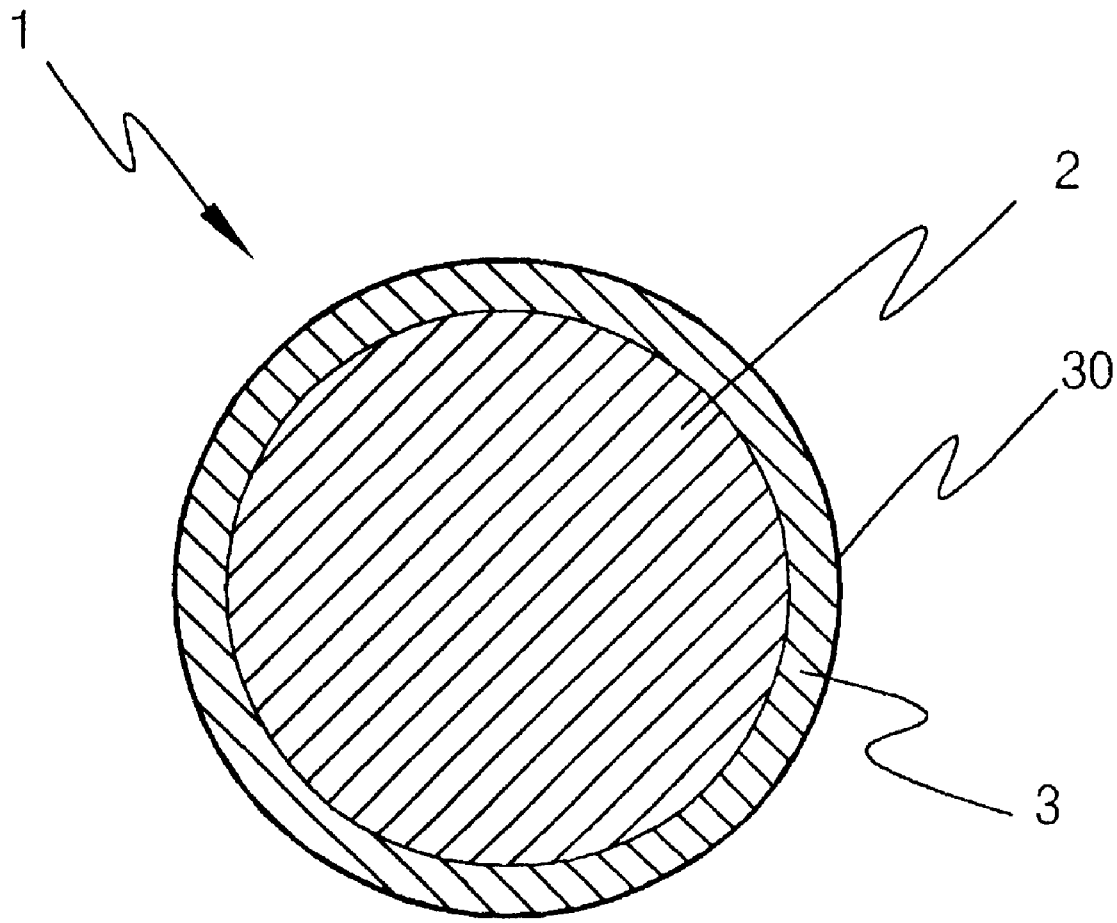
FIG. 3 is a sectional view of the brayer ball according to the primary embodiment of this invention.

FIG. 2 is a front view, showing the appearance of a brayer ball in accordance with the primary embodiment of the present invention. FIG. 3 is a sectional view of the brayer ball according to the primary embodiment of this invention. As shown in the drawings, the brayer ball 1 according to the primary embodiment of this invention comprises a spherical solid or hollow core body 2, and a ball cover 3 formed on the spherical core body 2 and having an external pattern 30 consisting of a variety of letters, figures and/or characters. In the primary embodiment, each of the core body 2 and the ball cover 3 is fabricated as a single structure.

Figure 4A:
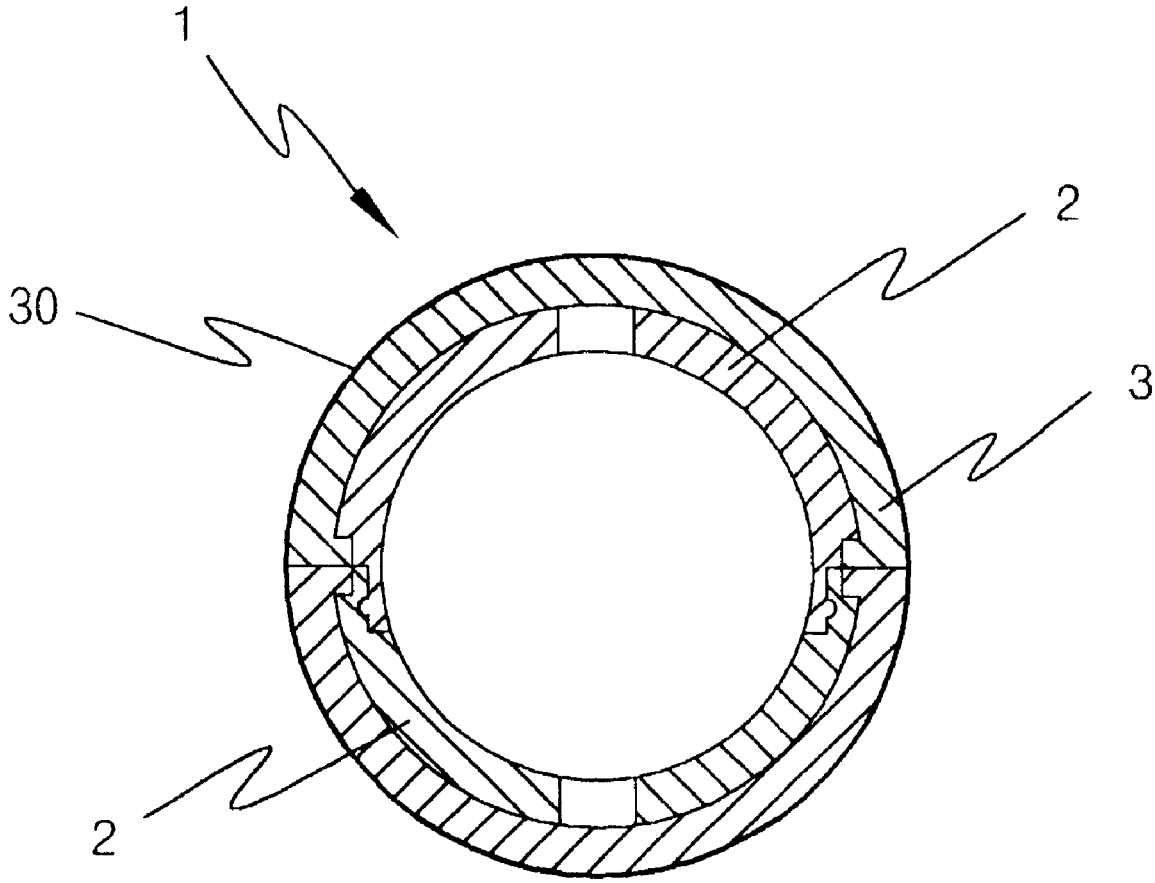
FIGS. 4*a* to 4*c* are sectional views of three brayer balls in accordance with second, third and fourth embodiments of the present invention.
Figure 4B:
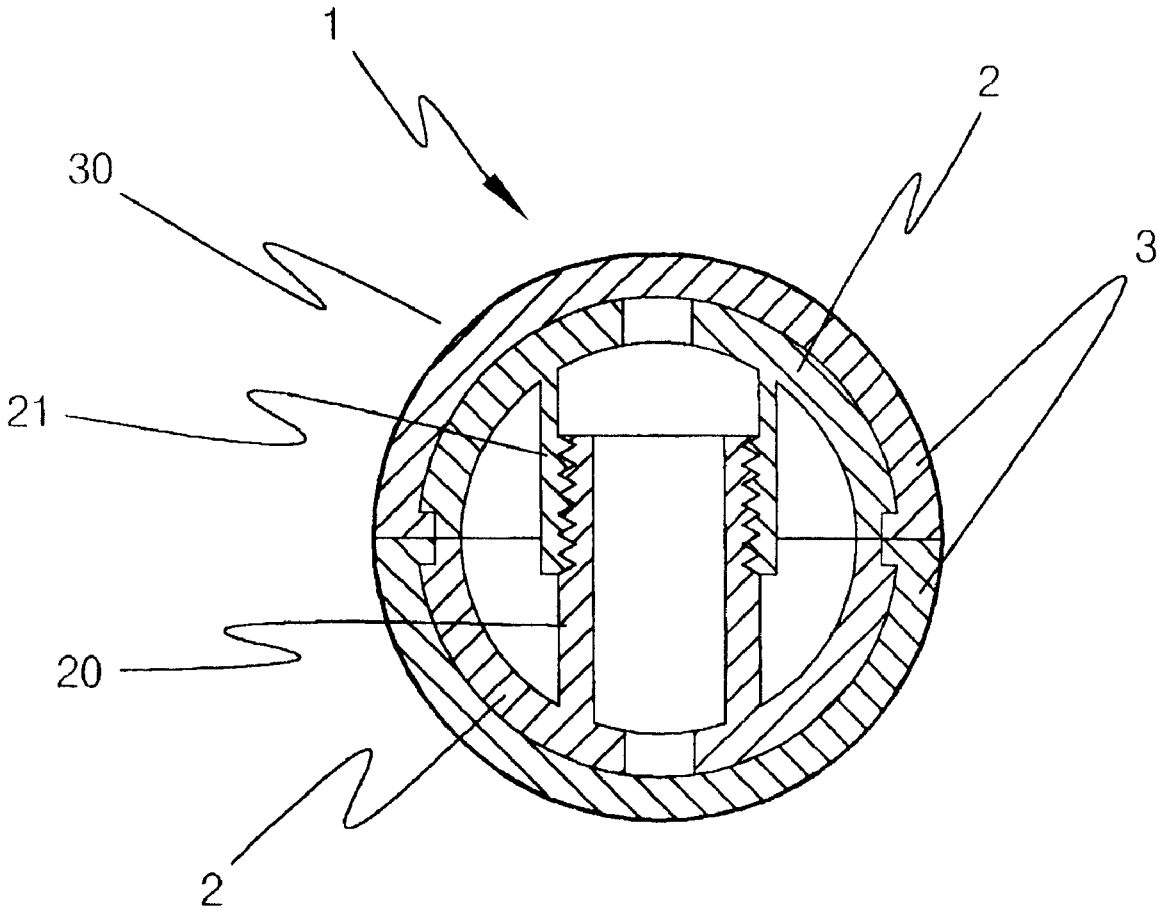
Figure 4C:
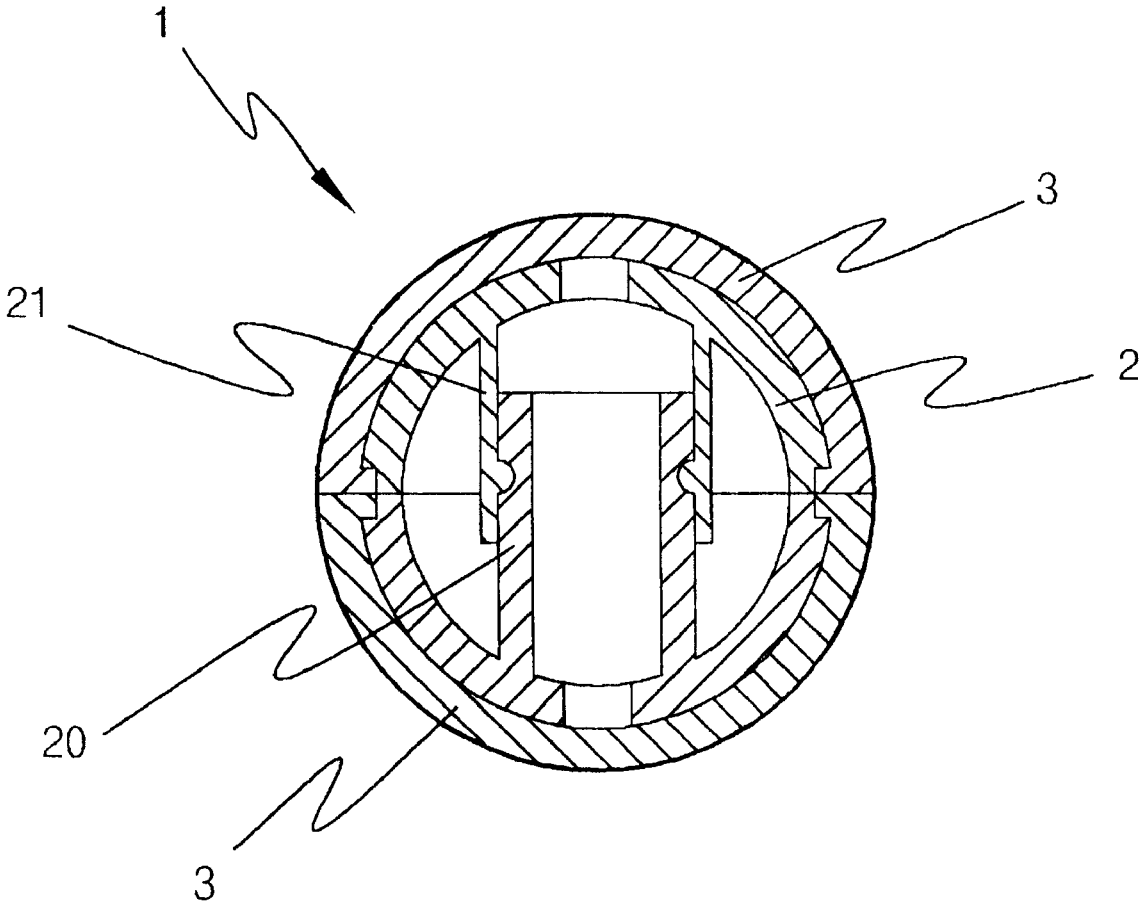

FIGS. 4*a* to 4*c* are sectional views of three brayer balls 1 in accordance with second, third and fourth embodiments of the present invention. As shown in the drawings, the spherical core body 2 may be fabricated with a separable body consisting of two or more parts.

In the embodiments of FIGS. 4*a* to 4*c*, the separable core body 2 consists of two hemispherical parts, which are assembled into a single spherical body by means of a pair of locking members 20 and 21.

That is, in the second and fourth embodiments of FIGS. 4*a* and 4*c*, the locking members 20 and 21 for assembling the two hemispherical parts into a single spherical core body comprise a fitting groove formed on one part and a fitting projection formed on the other part. In the embodiments, the fitting projection 21 engages with the fitting groove 20, thus assembling the two hemispherical parts into a single spherical core body. In the third embodiment of FIG. 4*b*, the locking members 20 and 21 comprise an externally-threaded member 20 and an internally-threaded member 21, which engage with each other to assemble the two hemispherical parts into a single spherical core body.

The brayer ball 1 of this invention is rotatably held by two brackets formed on the ball holder head of a brayer's handle (not shown) such that the ball 1 is partially exposed to the outside of the ball holder head. In order to stamp a desired pattern on a target sheet using the brayer ball 1, a user rolls the brayer ball 1 on an inkpad with appropriate pressure, to allow the pattern 30 of the ball cover 3 to be smeared with ink.

When the spherical brayer ball 1 of this invention is rolled on an inkpad to allow the pattern 30 of the ball cover 3 to be smeared with ink as described above, the brayer ball 1 is different from a conventional cylindrical brayer roller 400 in its ink smearing effect as follows. That is, when the conventional brayer roller 400 is linearly rolled on an inkpad to the front, back, left or right to be smeared with ink on its patterned surface, the patterned surface may be not smeared with ink on a part thereof in the case of a roller 400 having a large outer diameter. In addition, when the brayer roller 400 has a length exceeding the length of the inkpad, it is necessary to primarily roll the roller 400 on the inkpad to smear ink on one side of the longitudinal roller 400, and secondarily roll the remaining side of the roller on the inkpad to smear ink on that remaining side. However, in such a case, the primarily smeared ink on the patterned surface of the roller 400 is exposed to atmospheric air and undesirably dried when the roller 400 is secondarily rolled on the inkpad. It is thus impossible for the conventional cylindrical brayer roller 400 to accomplish a desired stamping effect.

However, since the brayer ball 1 of this embodiment is rotatable in every direction at an angle of 360°, the ball 1 is uniformly smeared with ink on its pattern 30, in addition to only requiring a small diameter area on an inkpad when the ball 1 rolls on the pattern 30.

After smearing ink on the pattern 30 of the brayer ball 1, the ball 1 is rolled on a target sheet in every direction with appropriate pressure, thus stamping an inked pattern on the sheet by the pattern 30 consisting of letters, figures and/or characters.

In the primary embodiment of this invention, the spherical core body 2 is fabricated with an integrated single structure. However, the spherical core body 2 may be fabricated with a separable body consisting of two or more parts as shown in FIGS. 4*a* to 4*c*.

In the second to fourth embodiments of FIGS. 4*a* to 4*c*, the separable core body 2 consists of two hemispherical parts, with the engaging edges of the two hemispherical parts forming male and female edges. The two hemispherical parts are assembled into a single spherical body by means of the locking members 20 and 21. In such a case, the ball cover 3 preferably consists of two or more separable parts such that the cover 3 may be replaced with another one. It is thus possible to easily change the pattern 30 as desired. In the second and fourth embodiments of FIGS. 4*a* and 4*c*, the locking members 20 and 21 comprise a fitting groove and a fitting projection. In the third embodiment of FIG. 4*b*, the locking members 20 and 21 comprise an externally-threaded member and an internally threaded member. When the brayer ball 1 comprises a separable spherical core body 2 and a separable ball cover 3 as described above, it is easy to change or repair the body 2 or the ball cover 3 when necessary. The brayer ball 1 is thus convenient to users.

In addition, the brayer ball 1 of this embodiment is rotatable at an angle of 360°, and so the ball 1 is effectively rotatable in every direction when the ball 1 is rolled on an inkpad or on a target sheet.

That is, the brayer ball 1 of this invention is effectively rotatable in every direction while being easily turned to left or right when the ball 1 is linearly rolled on an inkpad or on a target sheet to the front or back. Therefore, the brayer ball 1 is uniformly smeared with ink on its pattern 30 during a rolling action on the inkpad and uniformly stamps a pattern on a target sheet during a rolling action on the sheet. During such a rolling action, the brayer ball 1 is easily and smoothly rotated, and rolls along a short distance to be effectively smeared with ink on its pattern 30, and stamp a desired inked pattern onto a target sheet.

As described above, the present invention provides a brayer ball, which is fabricated with a patterned ball cover, having an external pattern consisting of letters, figures and/or characters and formed on a spherical core body. The brayer ball of this invention thus smoothly rolls on a target sheet in any desired direction without being limited in its rolling direction during a stamping process while preventing a stamped pattern from being distorted, deformed, or undesirably, partially faint or broken, different from a conventional cylindrical brayer roller. This brayer ball is also easily and smoothly rotated, and rolls along a short distance to effectively smear ink on its pattern or stamp a clear inked pattern on a target sheet. The brayer ball of this invention thus accomplishes a desired stamping effect.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A brayer ball, comprising:

a spherical solid or hollow core body; and a ball cover formed on said spherical core body and having an external pattern consisting of a variety of letters, figures and/or characters.

2. The brayer ball according to claim 1, wherein said spherical core body is a separable core body comprising at least two separable parts assembled together into a single structure by locking members.

3. The brayer ball according to claim 2, wherein said separable parts of the spherical core body have male and female edges at their engaging edge, and said ball cover is a separable ball cover comprising at least two separable parts.

4. The brayer ball according to claim 2, wherein said locking members comprise an externally-threaded member and an internally-threaded member.

5. The brayer ball according to claim 2, wherein said locking members comprise a fitting groove and a fitting projection.

6. A brayer ball, comprising:

a spherical solid or hollow core body; and means for printing a pattern, comprising a ball cover formed on said spherical core body and having an external pattern consisting of a variety of letters, figures and/or characters.

7. The brayer ball according to claim 6, wherein said spherical core body is a separable core body comprising at least two separable parts assembled together into a single structure by locking members.

8. The brayer ball according to claim 7, wherein said separable parts of the spherical core body have male and female edges at their engaging edge, and said ball cover is a separable ball cover comprising at least two separable parts.

9. The brayer ball according to claim 7, wherein said locking members comprise an externally-threaded member and an internally-threaded member.

10. The brayer ball according to claim 7, wherein said locking members comprise a fitting groove and a fitting projection.

11. In a brayer adapted to print a pattern on a surface, said brayer comprising a printing element, the improvement wherein:

said printing element is a brayer ball comprising a spherical solid or hollow core body; and a ball cover formed on said spherical core body and having an external pattern consisting of a variety of letters, figures and/or characters.

12. The brayer according to claim 11, wherein said spherical core body is a separable core body comprising at least two separable parts assembled together into a single structure by of locking members.

13. The brayer according to claim 12, wherein said separable parts of the spherical core body have male and female edges at their engaging edge, and said ball cover is a separable ball cover comprising at least two separable parts.

14. The brayer according to claim 12, wherein said locking members comprise an externally-threaded member and an internallythreaded member.

15. The brayer according to claim 12, wherein said locking members comprise a fitting groove and a fitting projection.

* * * * *